US007584758B2

(12) United States Patent
Focke et al.

(10) Patent No.: US 7,584,758 B2
(45) **Date of Patent: *Sep. 8, 2009**

(54) DEVICE FOR PROCESSING TOBACCO DURING THE PRODUCTION OF CIGARETTES

(75) Inventors: Heinz Focke, Verden (DE); Doris Focke, legal representative, Verden (DE); Jürgen Focke, legal representative, Verden (DE); Ralf Barkmann, Hamburg (DE); Alfred Drenguis, Börnsen (DE); Frauke Illigner, Grönwohld (DE); Reinhard Hoppe, Tespe (DE); Tobias Jacobi, Winsen/Luhe (DE); Christina Ott, Hamburg (DE); Remo Schulz, Stelle (DE); Michael Wegmann, Hamburg (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 146 days.

This patent is subject to a terminal disclaimer.

(21) Appl. No.: 10/533,221

(22) PCT Filed: Oct. 25, 2003

(86) PCT No.: PCT/EP03/11870

§ 371 (c)(1), (2), (4) Date: Apr. 29, 2005

(87) PCT Pub. No.: WO2004/039182

PCT Pub. Date: May 13, 2004

(65) Prior Publication Data

US 2006/0096606 A1 May 11, 2006

(30) Foreign Application Priority Data

Oct. 31, 2002 (DE) ..... 102 51 210

(51) Int. Cl.

| | |
|---|---|
| *A24B 1/02* | (2006.01) |
| *A24B 3/06* | (2006.01) |
| *A24C 1/02* | (2006.01) |
| *A24C 5/39* | (2006.01) |

(52) U.S. Cl. ..... 131/109.2; 131/110; 131/109.3; 131/108; 131/84.2; 131/84.3

(58) Field of Classification Search ..... 131/109.2
See application file for complete search history.

(56) References Cited

U.S. PATENT DOCUMENTS 3,665,932 A 5/1972 Goldbach (Continued)

FOREIGN PATENT DOCUMENTS

DE 15 32 213 3/1970

(Continued)

*Primary Examiner*—Philip C Tucker
*Assistant Examiner*—Phu H Nguyen
(74) *Attorney, Agent, or Firm*—Sughrue Mion, PLLC

(57) ABSTRACT

A distributor or hopper is part of a cigarette production machine and serves for dressing the tobacco in the provision of a continuous tobacco strand. An integral part of a distributor is a metering system which prepares the tobacco for the production of the tobacco strand. To separate out undesirable constituents, such as foreign bodies, stalks or ribs, from the tobacco, at least one sifter (15) is provided. The latter precedes the metering system of the distributor in the working direction, in particular is arranged outside the distributor, so that sifted tobacco is introduced into the distributor.

6 Claims, 6 Drawing Sheets

U.S. PATENT DOCUMENTS

Figure 2:
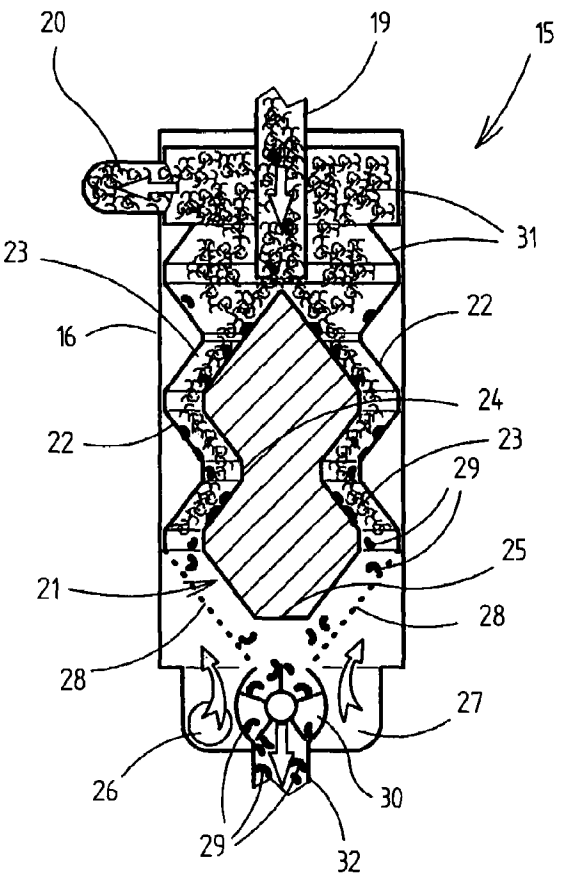

| | | | | |
|---|---|---|---|---|
| 5,267,576 | A * | 12/1993 | Heitmann | 131/84.1 |
| 5,645,086 | A * | 7/1997 | Brand et al. | 131/84.3 |
| 6,782,890 | B2 * | 8/2004 | Barkmann et al. | 131/110 |
| 2003/0034040 | A1 * | 2/2003 | Barkmann et al. | 131/84.3 |

FOREIGN PATENT DOCUMENTS

| | | | |
|---|---|---|---|
| DE | 198 40 143 | A1 | 3/2000 |
| DE | 299 24 015 | | 1/2002 |
| DE | 101 54 807 | A1 | 5/2003 |
| EP | 1 285 592 | A2 | 2/2003 |
| GB | 378 143 | | 8/1932 |
| JP | 08-256750 | A | 10/1996 |
| JP | 2957173 | B1 | 7/1999 |
| JP | 2003-070455 | A | 3/2003 |
| WO | WO 01/39899 | A1 | 6/2001 |

* cited by examiner

DEVICE FOR PROCESSING TOBACCO DURING THE PRODUCTION OF CIGARETTES

DESCRIPTION

The invention relates to a device for the dressing of fibrous material for further processing, in particular to a distributor—which is known as a hopper—for the dressing of cut tobacco in the production of cigarettes, the tobacco being introduced into a closed container of the distributor and being treated in this by loosening up, the elimination of (tobacco) lumps and sifting, to form a tobacco strand, with the aid of a metering system.

Distributors or hoppers are an integral part of a cigarette production machine (maker). The cut and otherwise treated tobacco is introduced into the distributor in the region of an (upper) lock, and passes via a predistributor into the region of the metering system. The latter consists essentially of a specially designed metering roller, to which the tobacco is supplied in a uniform tobacco flow. In the prior art, downstream of this metering system thus or similarly designed, a sifting of the tobacco is carried out in order to eliminate constituents having a higher dead weight, in particular ribs, stalks and foreign objects. The tobacco is subsequently supplied to a strand conveyor which transports away an exactly dimensioned tobacco strand in order to form cigarettes.

The invention is based on the recognition that an optimum or complete sifting of the tobacco to eliminate constituents with a higher dead weight is important for the type of operation of the distributor/hopper and for the quality of the tobacco strand produced. The object on which the invention is based is, therefore, to develop further and improve a distributor, above all, with regard to the sifting of the tobacco.

To achieve this object, the device according to the invention is characterized in that the tobacco can be conducted through one or more sifters, the sifter or sifters preceding the metering system in the conveying direction of the tobacco.

According to the invention, therefore, the tobacco is sifted predominantly or exclusively in a region upstream of the metering system, so that tobacco freed of stalks, ribs and foreign objects is supplied to the metering system.

A particular feature of the invention is that at least one sifter precedes the distributor, overall, in such a way that the oncoming tobacco is first conducted through the sifter and, thereafter, tobacco freed of constituents having a higher dead weight is conducted into the distributor or into a lock of the latter.

The sifter may be designed in various ways. A particular feature is the use of a cone-type sifter, above all with regard to the positioning of the sifter outside the distributor or in front of the lock of the latter. This proposal is based on the recognition that cone-type sifters can also be employed, with surprising advantages, for the sifting of fibrous materials, such as cut tobacco. The sifted tobacco is in this case conducted directly into the distributor or into the lock of the latter by the blast or compressed air supplied to the sifter.

Alternatively or additionally, a sifter may also be positioned within the distributor, specifically preferably in the version with a zigzag-shaped sifting zone (zigzag sifter). It is advantageous to position at least one sifter downstream of a predistributor which consists of a plurality of rotating members for loosening of the tobacco.

A further particular feature is the configuration of a conveying zone for the tobacco downstream of the sifter, to be precise for supply to the metering system.

Figure 1:
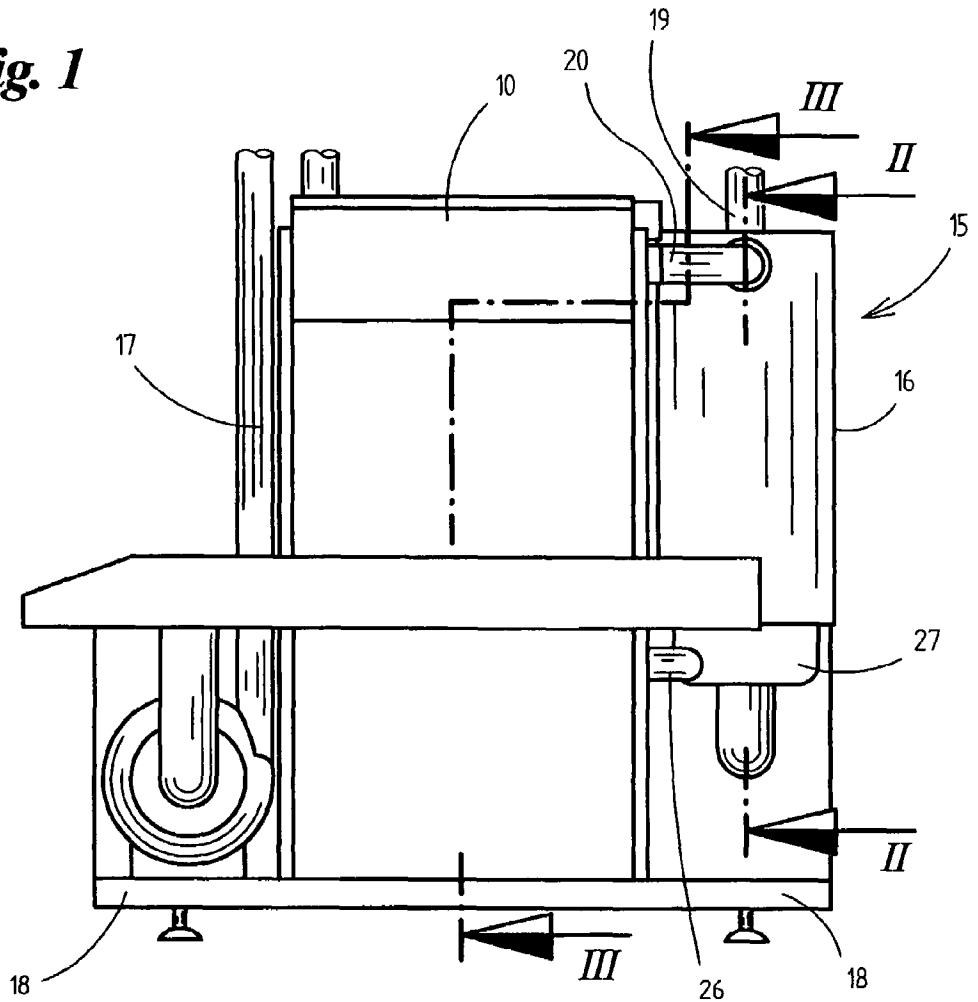
Figure 3:
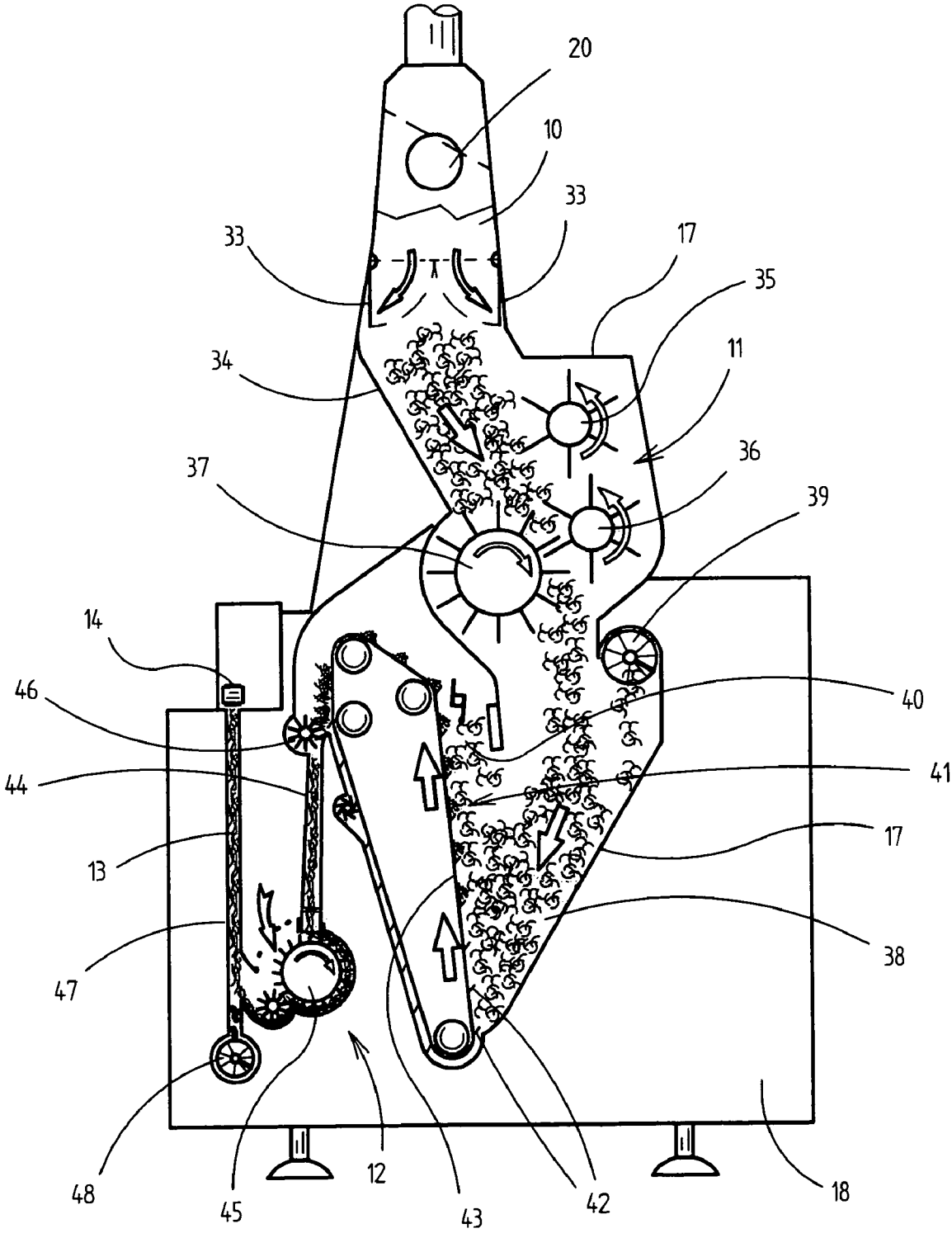
Figure 4:
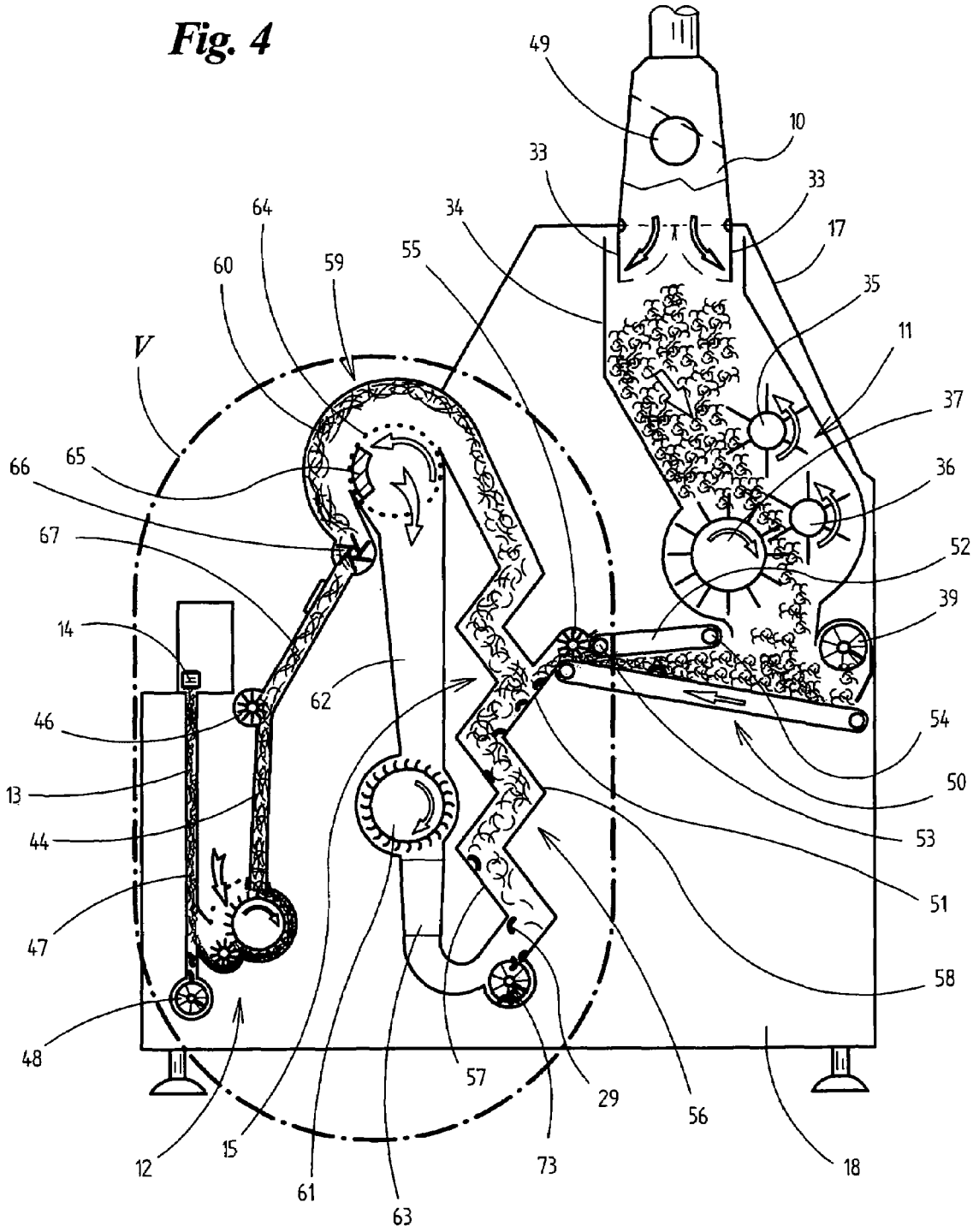
Figure 5:
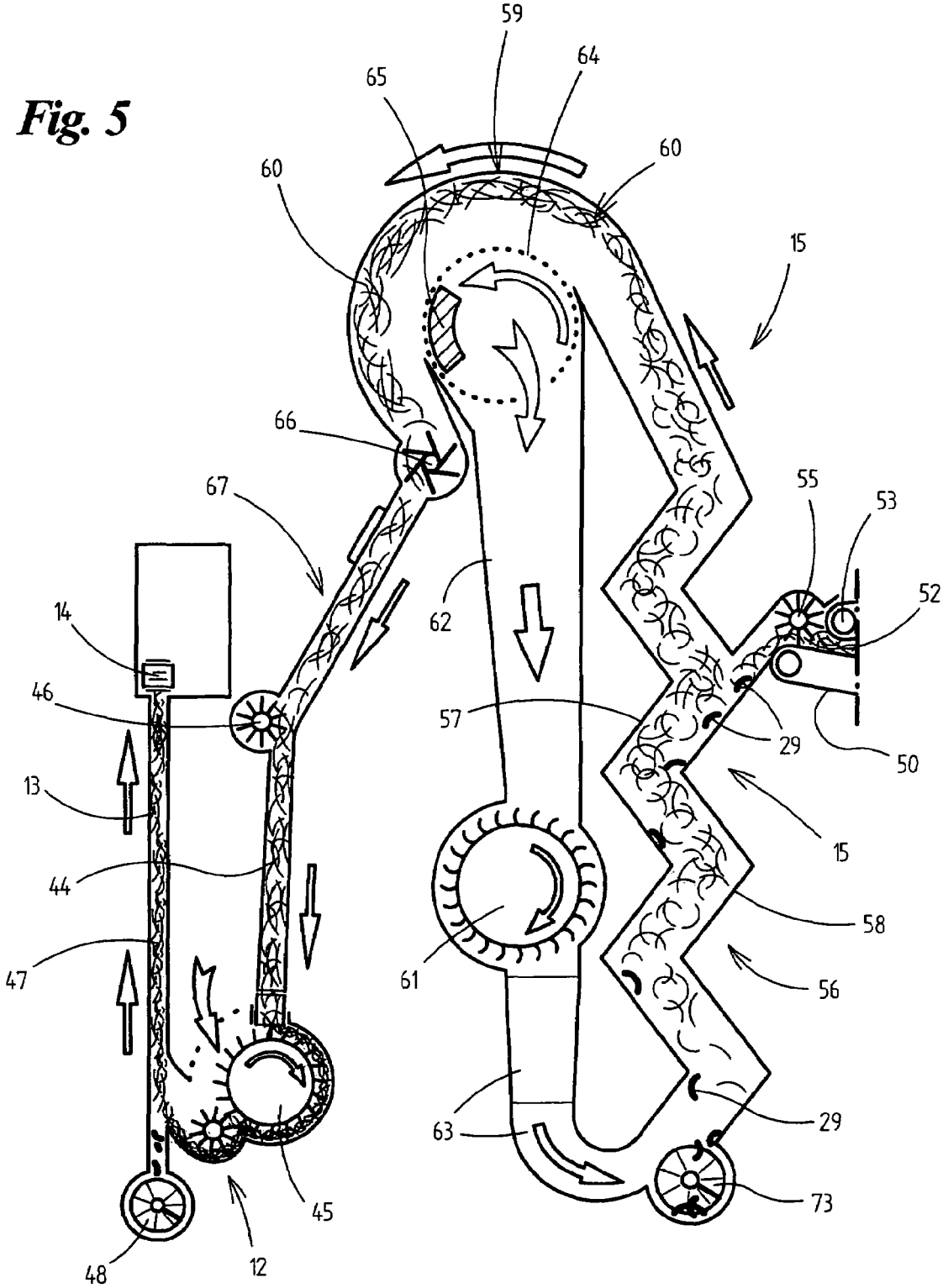
Figure 6:
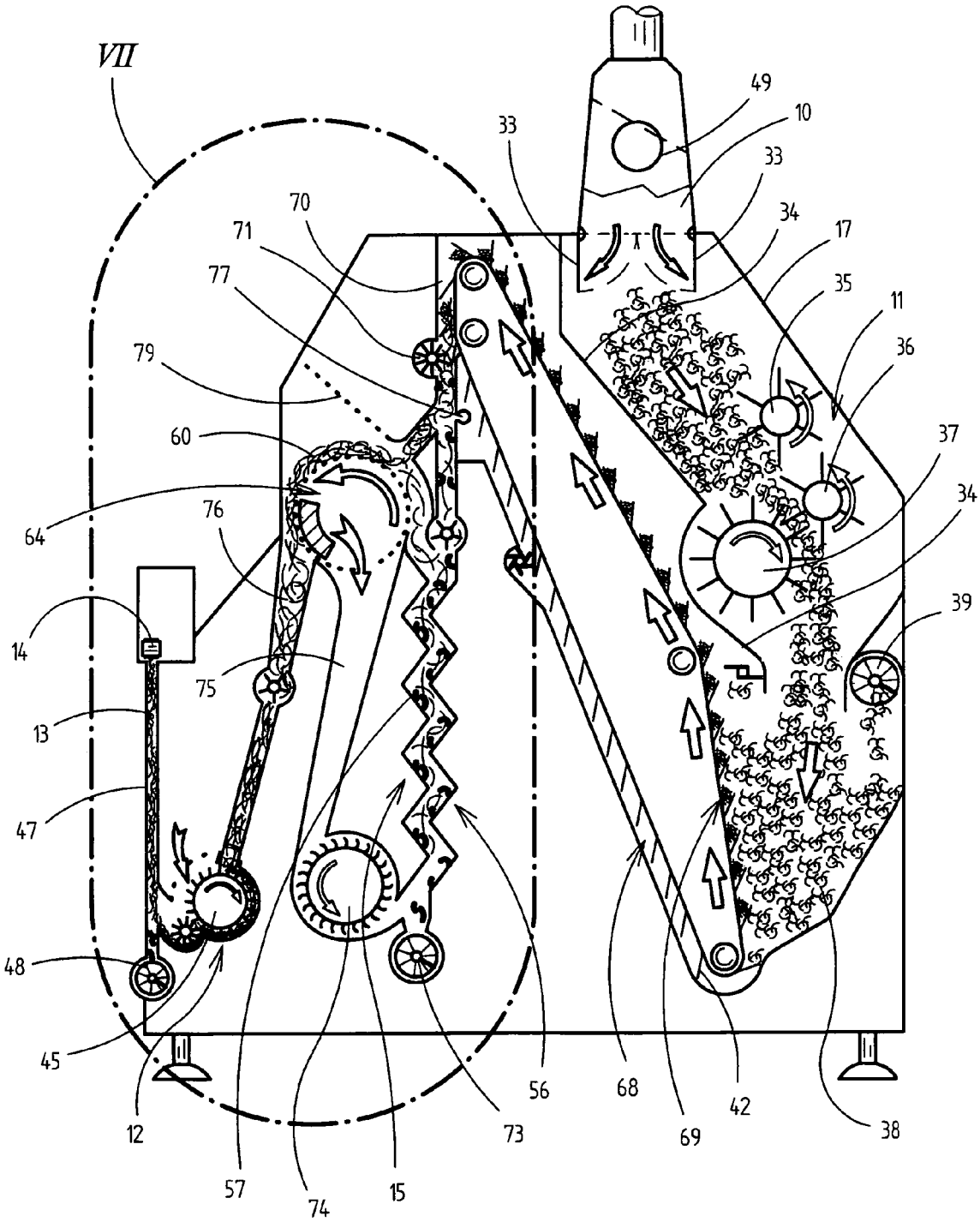
Figure 7:
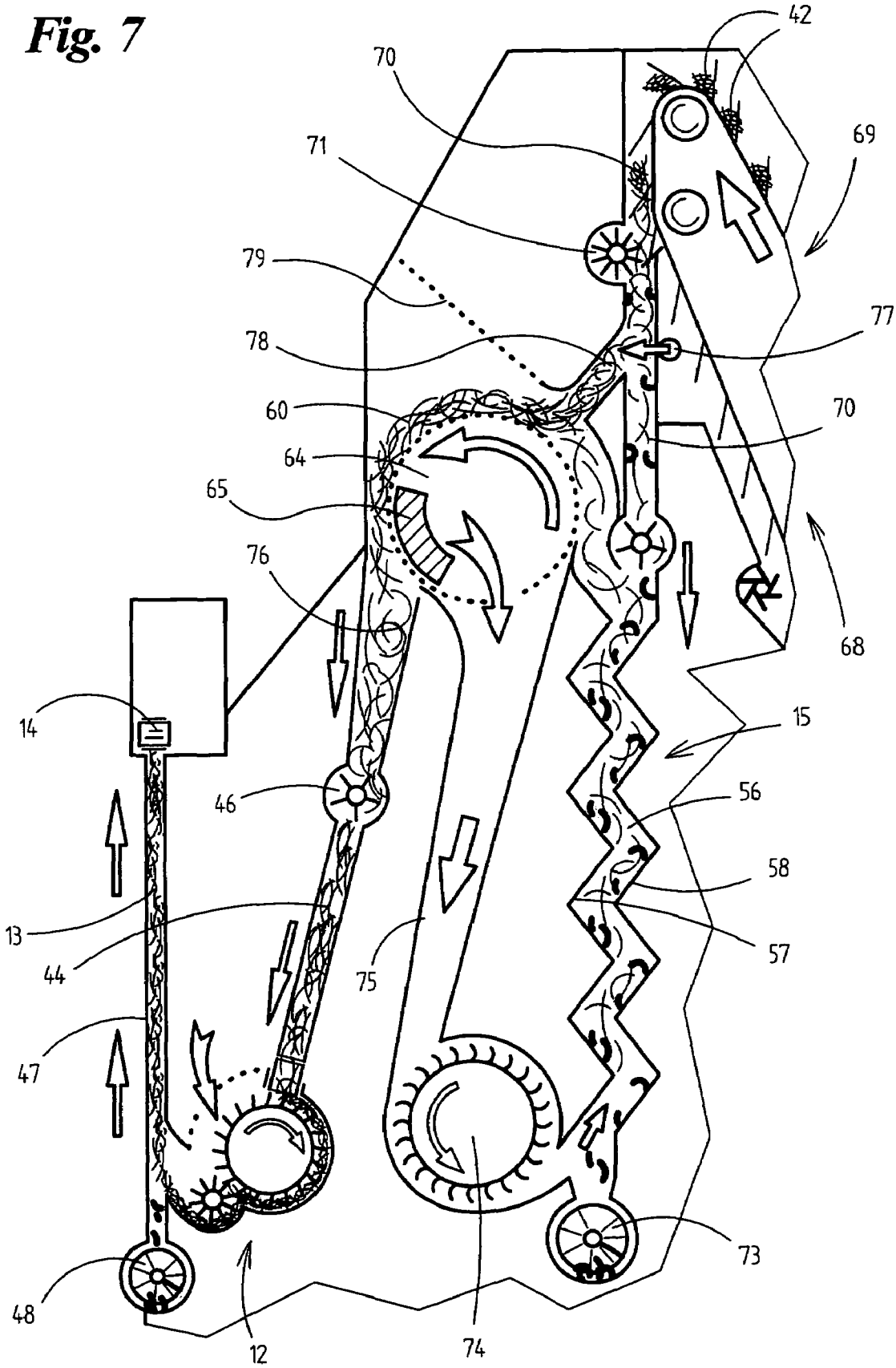

Further features of the invention are explained in more detail below by means of exemplary embodiments. In the drawing:

FIG. 1 shows a distributor in a side view,

FIG. 2 shows a detail of the distributor according to FIG. 1, to be precise a sifter, in the vertical section II-II of FIG. 1, FIG. 3 shows the distributor according to FIG. 1 in a vertical section in the sectional plane III-III of FIG. 1, on an enlarged scale, FIG. 4 shows another embodiment of a distributor in vertical section, FIG. 5 shows a detail V of the distributor according to FIG. 4 on an enlarged scale, FIG. 6 shows a third embodiment of a distributor in vertical section, FIG. 7 shows a detail VII of the distributor according to FIG. 6 on an enlarged scale.

The distributors or hoppers illustrated in the drawings serve for the dressing of cut tobacco. The latter is introduced, in an upper region, into the distributor, to be precise into a lock 10. The tobacco is transferred from this to a predistributor 11. A loosening-up of the tobacco takes place in the region of the latter. The tobacco is thereafter supplied to a metering system 12 in various ways. In the region of the latter, a largely regular tobacco stream 13 is produced, which is supplied in the upward direction to a member for producing a continuous tobacco strand, to be precise to a suction band 14.

An important component of the distributor is a sifter 15. This member separates constituents of the tobacco having a higher dead weight, in particular ribs, stalks, but also foreign objects, such as metal parts, stones, etc., from the tobacco. Where the present distributors are concerned, a sifter 15 is arranged in each case upstream of the metering system 12 in the conveying direction of the tobacco, so that sifted tobacco is supplied to the metering system 12.

A particular feature is the distributor according to FIG. 1 to 3. Where this is concerned, the sifter precedes the distributor or the lock 10. In point of fact, the sifter 15 is positioned as a separate member next to the distributor, specifically in a sifter housing 16. The latter is connected to the distributor, to be precise to a distributor housing 17. The unit thus obtained is arranged on a common machine stand 18.

The otherwise pretreated cut tobacco is supplied to the sifter 15. For this purpose, a supply line 19 or a supply pipe enters the sifter 15 from above in the vertical direction. The tobacco processed within the sifter 15 is introduced into the distributor, specifically into the lock 10 of the latter, in the upper region of the sifter 15 or of the sifter housing 16 via a connecting line 20, to be precise a horizontally directed pipe.

The sifter 15 according to the exemplary embodiment of FIG. 1 to FIG. 3 is designed in a special way, to be precise as a (modified) cone-type sifter. This consists of an upright guide body 21 preferably positioned centrally within the sifter housing 16 and of a guide wall 22 arranged at a distance from the said guide body. Between the guide body 21 and guide wall 22 is formed an upright sifting duct 23, the shape of which is determined by the contours of the guide body 21, on the one hand, and by those of the outer guide wall 22, on the other hand. In the present particular exemplary embodiment, the guide body 21 has a conical design, and, to be precise, consists of two double cones which lie one above the other and which are connected to one another in the region of a cross-sectional narrowing 24 to form a unit or a common guide body 21. This tapers to a point at the top and is provided at the bottom with a truncated end 25.

The guide body 21 is positioned centrally within the sifter housing 16 and is surrounded by the guide wall 22 in such a way as to form, as seen in horizontal section, an annular sifting duct 23, the effective transverse dimension of which is approximately identical over the height, specifically owing to the adaptation of the guide wall 22 to the contours of the guide body 21. The guide wall 22 runs parallel to and at a constant distance from the guide body 21.

The tobacco is introduced into the sifter 15 via the supply line 19 arranged centrically with respect to the guide body 21 and above the latter. The tobacco moves, by virtue of its dead weight, downwards in the region of the sifting duct 23, specifically along the outer surface area of the guide body 21. The downwardly directed movement of the tobacco is counteracted by an airflow supplied from below. Air under increased pressure is introduced via an air line 26 into the lower region of the sifter 15 or of the sifter housing 16. The air line 26 issues in a lower chamber 27 and enters the sifter housing 16 in the upward direction. The lower region of the guide wall 22 is designed to be air-permeable, to be precise as an obliquely directed or conical sieve 28. The air enters the sifting duct 23 in an upwardly directed flow via this sieve-like lower region of the guide wall 22 and counteracts the downward movement of the tobacco. The light cut tobacco is thereby forced back in the upward direction, whilst pieces 29 having a higher dead weight (stalks, ribs, foreign objects) which are to be separated out fall downwards counter to the air stream. Located in the lower end of the sifting duct 23 is a discharge member for the pieces 29, to be precise a cellular wheel 30 with discharge 32.

The tobacco freed of the pieces 29 to be separated out passes into a region above the guide body 21, to be precise into a collecting chamber 31 of widened cross section. This is followed, above it, by the connecting line 20 for transferring the sifted tobacco to the actual distributor. In this exemplary embodiment, the distributor is configured in a special way as a result of the absence of a sifter within the distributor or within the distributor housing 17. A vacuum prevails in the lock 10 formed in the upper region, so that, in conjunction with the airflow in the sifter 15, the tobacco passes out of the collecting chamber 31 via the connecting line 20 to the lock 10. The tobacco is supplied in portions or batchwise to the sifter 15 and consequently to the distributor. The tobacco portion treated in the sifter 15 is collected in the lock 10 and is then supplied to the actual distributor. The lock 10 has a lower closable orifice. In the present exemplary embodiment, a lock bottom consists of two pivotable flaps 33. These are pivoted downwards in order to open the lock 10. The entire content of the lock 10 thereby passes into the region of the predistributor 11.

In the predistributor, the tobacco is supplied by means of an obliquely directed guidance wall 34 to working members. These are (three) spiked rollers 35, 36, 37 which, by virtue of arrangement and size, control the free throughflow of the tobacco downwards into the region of a funnel-shaped collecting container 38. The spiked rollers 35 . . . 37 are provided with radially directed spikes which, by virtue of their configuration and arrangement, have the effect of loosening up the tobacco, but also of guiding the tobacco stream. What is achieved is that the tobacco passes in a loosened up tobacco flow into the downwardly tapering collecting container 38 below the predistributor 11. The spiked rollers 35 . . . 37 are in this case arranged in such a way that a spiked roller 37 of larger diameter and a smaller spiked roller 36 are located opposite one another and, as a result of the mutual engagement of spikes, form a barrier for the tobacco. The latter can pass downwards solely in accordance with the rotational movements of the spiked rollers 36, 37. A further spiked roller 35 is located in a region above the spiked roller 36 and serves for feed-conveyance of the tobacco in such a way that the latter is conducted predominantly to the larger spiked roller 37. The particularly advantageous direction of rotation of the spiked rollers 35, 36, 37 is identified in each case by a direction arrow in FIG. 3.

In the upper region of the funnel-shaped collecting container, in any event below the predistributor 11, is arranged a feed conveyor—conveying worm 39—which guides excess tobacco out of the region of the tobacco strand into the collecting container 38. The guidance wall 34 is configured in such a way that it follows the contour of the spiked roller 37 of the predistributor 11 and ends in the upper region of the collecting container 38 so as to form a cross-sectional narrowing 40.

The tobacco is conveyed upwards out of the collecting container 38, specifically by means of a steep-angle conveyor 41. This is an endless conveyor which has obliquely directed dogs 42 for in each case picking up a tobacco quantity in the region of an upwardly moved conveying side 43. The latter is inclined slightly with respect to a vertical position, specifically with an inclination of about 6°.

The conveyor, to be precise the steep-angle conveyor 41, is deflected via deflecting rollers into a downwardly directed conveying zone. In this region, the tobacco is transferred to the metering system 12. The tobacco in this case passes into an essentially upright well 44 which supplies the tobacco to a metering roller 45, to be precise a spiked roller. In the upper entry region of the well 44 is located a member for removing the tobacco from the steep-angle conveyor 41. This is a separating roller 46 which combs the tobacco out of the comb-like dogs 42.

The uniform tobacco stream 13 is produced in the region of the metering system 12 or of the metering roller 45 and is led via an upright conveyor, to be precise a suction well 47, to the suction band 14. At the lower end of the suction well 47 is arranged a discharge-conveyor member, to be precise a transversely directed conveying worm 48. The latter has the task, in the event of a machine standstill, of conveying away tobacco which is located in this region.

In the exemplary embodiment according to FIG. 4 and FIG. 5, the sifter 15 is accommodated within the distributor or within the correspondingly designed distributor housing 17, specifically downstream of the predistributor 11. The oncoming tobacco passes directly into the lock 10 via a supply line 49. The predistributor 11, in the version described, is located below the lock 10. The tobacco emerging from this predistributor 11 is received by a cross conveyor 50, to be precise an endless conveyor belt. The cross conveyor 50 or its upper side ascends slightly in the conveying direction, that is to say is directed at an acute angle. The cross conveyor 50 leads to an inlet orifice 51 into the sifter 15.

The cross conveyor 50 has cooperating with it a metering member, specifically a metering conveyor 52 which is positioned as an endless belt above the cross conveyor 50 at an angle to the cross conveyor 50. A deflecting end or deflecting roller 53, facing the inlet orifice 51, of the metering conveyor 52 forms, with respect to the cross conveyor 50, a metering gap for the passage of the tobacco to the sifter 15. The metering gap is adjustable, specifically as a result of the adjustment of the metering conveyor 52. The deflecting roller 54 of the latter, the said deflecting roller being remote from the inlet orifice 51, is mounted at a fixed location, whilst the opposite deflecting roller 53 is adjustable in the upward and downward direction. The metering conveyor 52 is therefore pivotable about the deflecting roller 54 so as to vary the metering gap defined by the cross conveyor 50.

A spike roller 55 is arranged as a conveying and distribution member in the region of the inlet orifice 51 to the sifter 15.

The sifter 15 is a zigzag sifter. An upright sifting duct 56 is multiply angled, that is to say has a zigzag-shaped design. Two parallel guidance walls 57, 58 define a sifting duct 56 having an alternating direction of flow. The tobacco passes via the inlet orifice 51, in the region of an obliquely directed leg of the guidance wall 58, into the sifter 15 or sifting duct 56. The tobacco sliding downwards under its dead weight is counteracted from below by an air stream which, while separating out pieces 29 having a higher dead weight, conveys the tobacco back upwards, specifically beyond the inlet orifice 51 into the region of a (circular) deflecting duct 59. This gives rise, in this region, to a tobacco stream 60 free of pieces 29. This tobacco stream 60 is supplied to the metering system 12.

The air introduced into the sifting duct 56 from below is generated by a blower or a fan 61 (cross-flow fan). The latter is located in an upright air duct 62 which forms with the sifting duct 56 a closed duct system. The blast air is introduced by the fan 61, via an arcuately deflected duct leg 63, from below into the sifting duct 56 and there generates the sifting action already described, in conjunction with an upwardly directed conveyance of the tobacco.

The upper region of the sifter 15 is designed in a special way (FIG. 4 and FIG. 5). An upper region of the air duct 62 leads to an air connection or to an air-permeable drum 64 designed, in particular, as a sieve. The latter is positioned rotatably and concentrically in the circular deflecting duct 58. The drum 64 is driven in rotation in the conveying direction of the tobacco or of the tobacco stream 60. The air is sucked into the air-permeable drum 64 via the sifting duct 56 by means of the fan 61 and is then introduced into the sifting duct 56 at the bottom via the air duct 62 and the duct leg 63.

The relatively light tobacco, after leaving the sifting duct 56, is lead along a circular wall of the deflecting duct 59 by means of the codirectional air flow. In this case, owing to centrifugal forces, the tobacco stream 60 bears against the wall of the deflecting duct 59. In a downwardly directed region of the latter, the drum 64, air-permeable overall, is sealed off relative to the passage of air by means of a stationary inner segment 65, so that, in this region of low centrifugal forces, the tobacco stream 60 is prevented from bearing against the drum 64.

The tobacco or tobacco stream 50 passes, downstream of the deflecting duct 59, into the region of a cellular-wheel sluice 66 as a conveying and sealing-off member with respect to the vacuum region of the sifter 15. The tobacco is transferred by the cellular-wheel sluice 66 to an oblique duct 67 which leads to the separating roller 46 arranged at the entrance of the well 44. The tobacco consequently passes into the region of the metering system 12 which is designed here in the same way as in the exemplary embodiment of FIG. 3.

In the exemplary embodiment according to FIG. 6 and FIG. 7, the sifter 15 is likewise accommodated within the distributor or within the distributor housing 17. As in the example of FIG. 4, the tobacco is supplied directly to the lock 10 and is transferred from this to the predistributor 11. The tobacco passes from here into the region of the collecting container 38 arranged below the predistributor 11. The tobacco is transported to the said collecting container by an upward conveyor 68, comparable in construction and functioning to the steep-angle conveyor 41 of FIG. 3, virtually over the entire height of the distributor. Downstream of an upper deflection of the upward conveyor 68 or of a conveying side 69, the tobacco is transferred into a downwardly directed upright or vertical transport well 70. The reliable removal of the tobacco from the upward conveyor 68 is brought about by a separating roller 71 which combs the tobacco out of the dogs 42 of the upward conveyor 68.

The transport well 70 leads in the vertical direction directly to the sifter 15 or the sifter 15 follows the transport well 70. In this exemplary embodiment, too, the sifter 15 is designed as a zigzag sifter with a corresponding sifting duct 56 which is delimited by angled parallel guidance walls 57, 58. Here, too, at the upper inlet end of the sifting duct 56, a processing roller 72 is arranged, which, on the one hand, causes the tobacco to be loosened up and, on the other hand, delimits the region of the sifter having an increased air pressure with respect to the preceding region—the transport well.

The sifting duct 56 is supplied from below with air which flows upwards and which conveys the tobacco upwards within the sifting duct 56, but allows the pieces 29 to fall downwards on account of the higher dead weight. Transporting away by means of a transversely directed worm 73 takes place there. The airflow is generated in the lower region, directly adjacent to the lower end of the sifting duct 56, specifically by means of a fan 74. The latter is arranged in a housing as part of an upright air duct 75. Once again, at the upper end of this air duct 75, an air-permeable drum 64 driven in rotation in the direction of the arrow is mounted. This gives rise, in this exemplary embodiment too, to a circulation of air. The air introduced into the sifter or sifting duct 56 at the bottom transports the tobacco into the region of the drum 64. The tobacco comes to bear here against the outer casing of the air-permeable drum 64 and is transported by the latter for transfer to an intermediate duct 76. This is followed, again, by the metering system 12, already described in principle, with separating roller 46 and well 44.

A particular feature is the upper region of the sifter 15 with a presifting of the tobacco. Air is introduced laterally in a region preceding the sifter 15 in the conveying direction, to be precise in the transport well 70. For this purpose, an air nozzle 77 is arranged next to the transport well 70 and is directed in such a way that air is directed into the transport well 70 and consequently into the tobacco stream in the transverse direction (arrow in FIG. 7).

Opposite the air nozzle 77, a branch duct 78 is formed. The issue of the latter forms an outlet orifice of the transport well 70. The air from the air nozzle 77 guides part of the tobacco by means of a cross flow out of the transport well 70 into the branch duct 78. The latter leads into a collecting region and is united with the tobacco supplied from the sifter 15, specifically on the casing of the drum 64.

Above the drum 64 is mounted an air-permeable boundary, to be precise an obliquely directed separating sieve 79. The latter prevents tobacco from passing through into the upper region of the sifter housing 16.

The exemplary embodiments shown with sifters configured in a special way, allow an extremely effective separation of the undesirable constituents from the tobacco by means of a compact construction and with high efficiency.

LIST OF REFERENCE SYMBOLS

10 lock
11 predistributor
12 metering stream
13 tobacco stream
14 suction band
15 sifter
16 sifter housing
17 distributor housing
18 machine stand

19 supply line
20 connecting line
21 guide body
22 guide wall
23 sifting duct
24 cross-sectional narrowing
25 end
26 air line
27 chamber
28 sieve
29 piece
30 cellular wheel
31 collecting chamber
32 discharge
33 flap
34 guidance wall
35 spiked roller
36 spiked roller
37 spiked roller
38 collecting container
39 conveying worm
40 cross-sectional narrowing
41 steep-angle conveyor
42 dog
43 conveying side
44 well
45 metering roller
46 separating roller
47 suction well
48 conveying well
49 supply line
50 cross conveyor
51 inlet orifice
52 metering conveyor
53 deflecting roller
54 deflecting roller
55 spike roller
56 sifting duct
57 guidance wall
58 guidance wall
59 deflecting duct
60 tobacco stream
61 fan
62 air duct
63 duct leg
64 drum
65 inner segment
66 cellular-wheel sluice
67 oblique duct
68 upward conveyors
69 conveying side
70 transport well
71 separating roller
72 separating roller
73 worm
74 fan
75 air duct
76 intermediate duct
77 air nozzle
78 branch duct
79 separating sieve

The invention claimed is:

1. A device for the dressing of cut tobacco in a particular distributor for the production of cigarettes, the tobacco being introduced into the distributor and being treated within the distributor by loosening up, by elimination of tobacco lumps and by sifting, and preparing the tobacco for forming a tobacco strand, with the aid of a metering system (12), characterized by the following features:

a) a cone-type sifter (15) for sifting the tobacco, wherein the sifter on one hand and the distributor for loosening up the tobacco and for elimination of the lumps on the other hand are separate equipments, the distributor being arranged in a distributor housing (17), and the sifter being arranged in a separate sifter housing (16) outside the distributor housing (17), b) the tobacco is first conveyed through the sifter (15) and after sifting the tobacco is conveyed by a connecting line (20) into the distributor or into the distributor housing (17) respectively, c) the tobacco is conveyed into the sifter (15) by a supply line (19) at an upper side of the sifter housing (16), while air is introduced into the sifter (15) by an airline (26) at a lower area of the sifter (15), d) the connecting line (20) for conveying the sifted tobacco into the sifter housing is arranged at the upper side of the sifter housing (16) on one hand and the distributor housing (17) on the other hand, e) the sifter (15) has an upright guide body (21) within the sifter housing (16), the sifter housing (16) being cylindrical, f) the guide body is of circular cross-section and consists of two double cones arranged one above the other, g) the guide body is arranged centrally within the sifter housing (16) and is surrounded by a guide wall (22) of circular cross section, and h) the guide wall (22) runs at a distance from an outer service area of the guide body (21) forming a wavy or zigzag-shaped sifting duct (23) between the guide body (21) and the guide wall (22).

2. The device according to claim 1, characterized in that the distributor and the sifter (15) are mounted on a machine stand (18) for both said equipments.

3. The device according to claim 1, characterized in that within the sifter (15) namely within the sifter housing (16) a collecting chamber for sifted tobacco is arranged above the guide body, the connecting line (20) being connected to the sifter (15) at the collecting chamber (31).

4. The device according to claim 1, characterized by the following features:

a) the airline (26) for conveying air into the sifter (15) is connected to the sifter (15) in the area of a chamber (27) in the lower area of the sifter (15), b) the guide wall surrounding the guide body (21) is designed to be air-permeable by an obliquely directed or conical sieve (28).

5. The device according to claim 1, characterized by the following features:

a) the connecting line (20) for conveying the sifted tobacco from the sifter (15) into the distributor is connected to the distributor housing (70) at a lock (10) within the distributor housing (17), b) a bottom of the lock consists of flaps (33) which are pivoted downwards in order to open the lock (10) to the distributor.

6. The device according to claim 1, wherein the sifter housing (16) is cylindrical, and the sifter (15) has an upright guide body (21) within the housing (16).

* * * * *